US008062062B1

(12) United States Patent
Guo et al.

(10) Patent No.: US 8,062,062 B1
(45) Date of Patent: Nov. 22, 2011

(54) ELECTRICAL CONNECTOR WITH DIFFERENT TYPES OF INTERFACE PORTS

(75) Inventors: Liang Guo, Shenzhen (CN); Mei Huang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/869,702

(22) Filed: Aug. 26, 2010

(30) Foreign Application Priority Data

Jul. 23, 2010 (CN) ..... 2010 1 0235412

(51) Int. Cl.
*H01R 13/60* (2006.01)

(52) U.S. Cl. ..... 439/540.1; 439/541.5

(58) Field of Classification Search ..... 439/540.1, 439/541.5
See application file for complete search history.

(56) References Cited

U.S. PATENT DOCUMENTS

| | | | | |
|---|---|---|---|---|
| 5,957,705 | A * | 9/1999 | David et al. | 439/79 |
| 6,200,161 | B1 * | 3/2001 | McClinton et al. | 439/541.5 |
| 7,677,923 | B1 * | 3/2010 | Chen et al. | 439/541.5 |
| 2005/0255746 | A1 * | 11/2005 | Hyland | 439/541.5 |
| 2007/0232131 | A1 * | 10/2007 | Ju | 439/541.5 |
| 2007/0232132 | A1 * | 10/2007 | Ling et al. | 439/541.5 |
| 2010/0035466 | A1 * | 2/2010 | Lee et al. | 439/541.5 |

* cited by examiner

*Primary Examiner* — Renee Luebke
*Assistant Examiner* — Larisa Tsukerman
(74) *Attorney, Agent, or Firm* — Altis Law Group, Inc.

(57) ABSTRACT

An exemplary electrical connector includes a housing, and a high definition multimedia interface and a digital visual interface received in the housing. The housing includes a sidewall. The sidewall defines a cutout and a window above the cutout. The high definition multimedia interface includes a high definition multimedia interface port received in the window and multiple pins protruding out from the housing. The digital visual interface includes a digital visual interface port received in the cutout and multiple pins protruding out from the housing.

16 Claims, 4 Drawing Sheets

ELECTRICAL CONNECTOR WITH DIFFERENT TYPES OF INTERFACE PORTS

BACKGROUND

1. Technical Field

The present disclosure relates to electrical connectors, and particularly to an electrical connector having different types of interface ports for matching different devices.

2. Description of Related Art

Many electronic devices, such as computers and liquid crystal display televisions (LCD TVs), need several types of connectors to provide various types of interface ports for connecting with different devices. The interface ports usually have different mechanical standards, e.g., interface widths. Examples of such interface ports include digital visual interface (DVI) ports, high definition multimedia interface (HDMI) ports, and universal serial bus (USB) ports. On the other hand, many modern electronic devices, particularly portable electronic devices such as notebook computers, are very compact and light. Such portable electronic devices often cannot provide enough space for installing various types of connectors therein.

What is needed, therefore, is a means which can overcome the limitations described.

DETAILED DESCRIPTION

Figure 1:
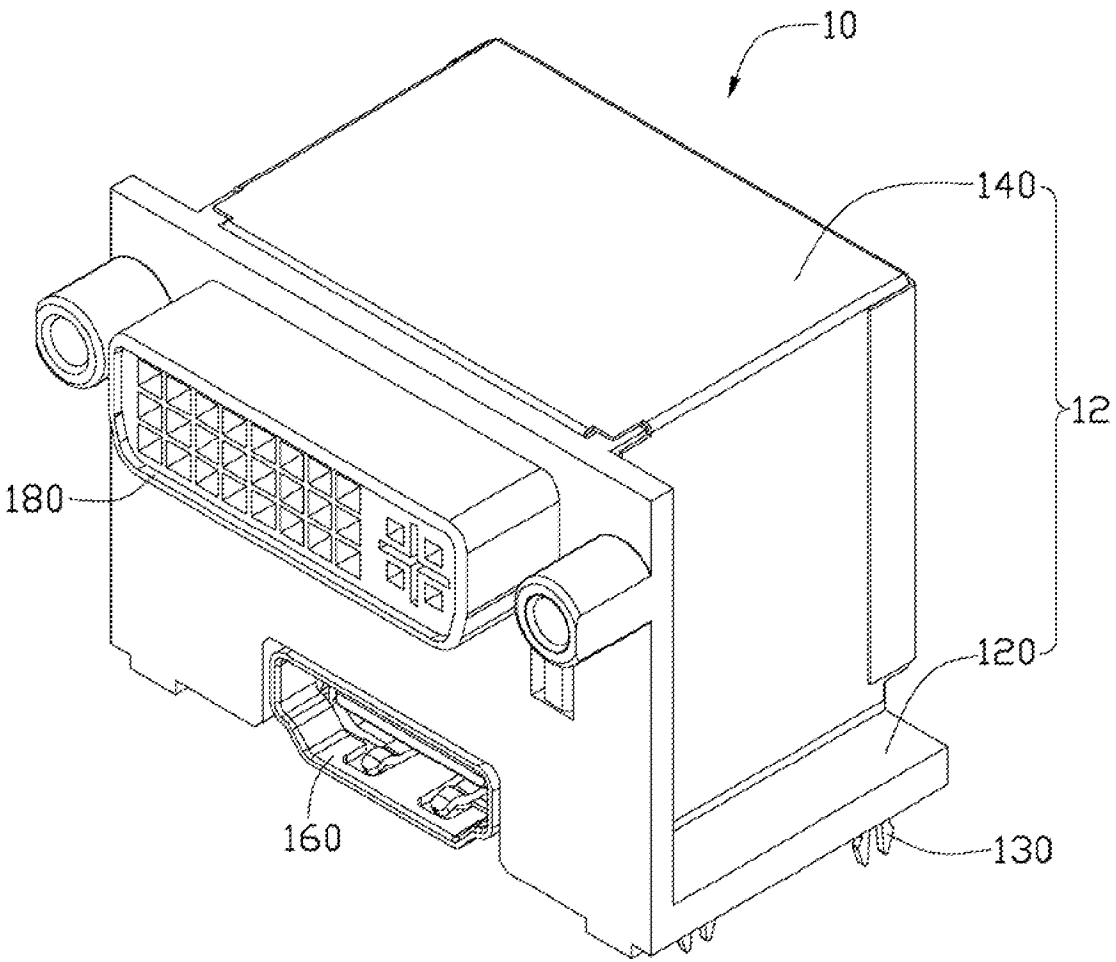
FIG. 1 is an isometric, assembled view of an electrical connector in accordance with an embodiment of the disclosure.

Referring to FIG. 1, an electrical connector 10 in accordance with an exemplary embodiment is shown. The connector 10 includes a housing 12, a high definition multimedia interface (HDMI) 16 and a digital visual interface (DVI) 18.

Figure 2:
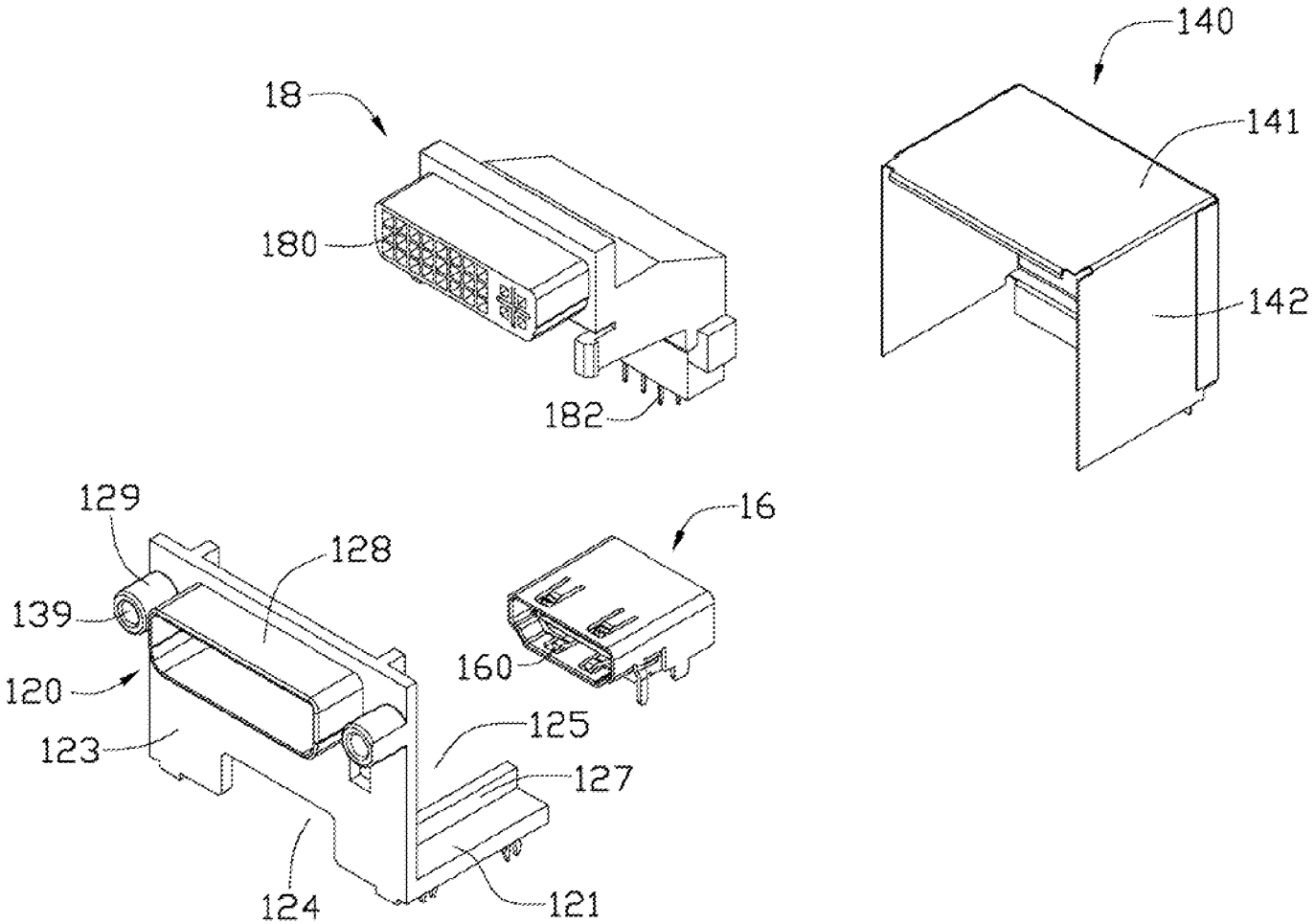
FIG. 2 is an exploded view of the electrical connector of FIG. 1.
Figure 3:
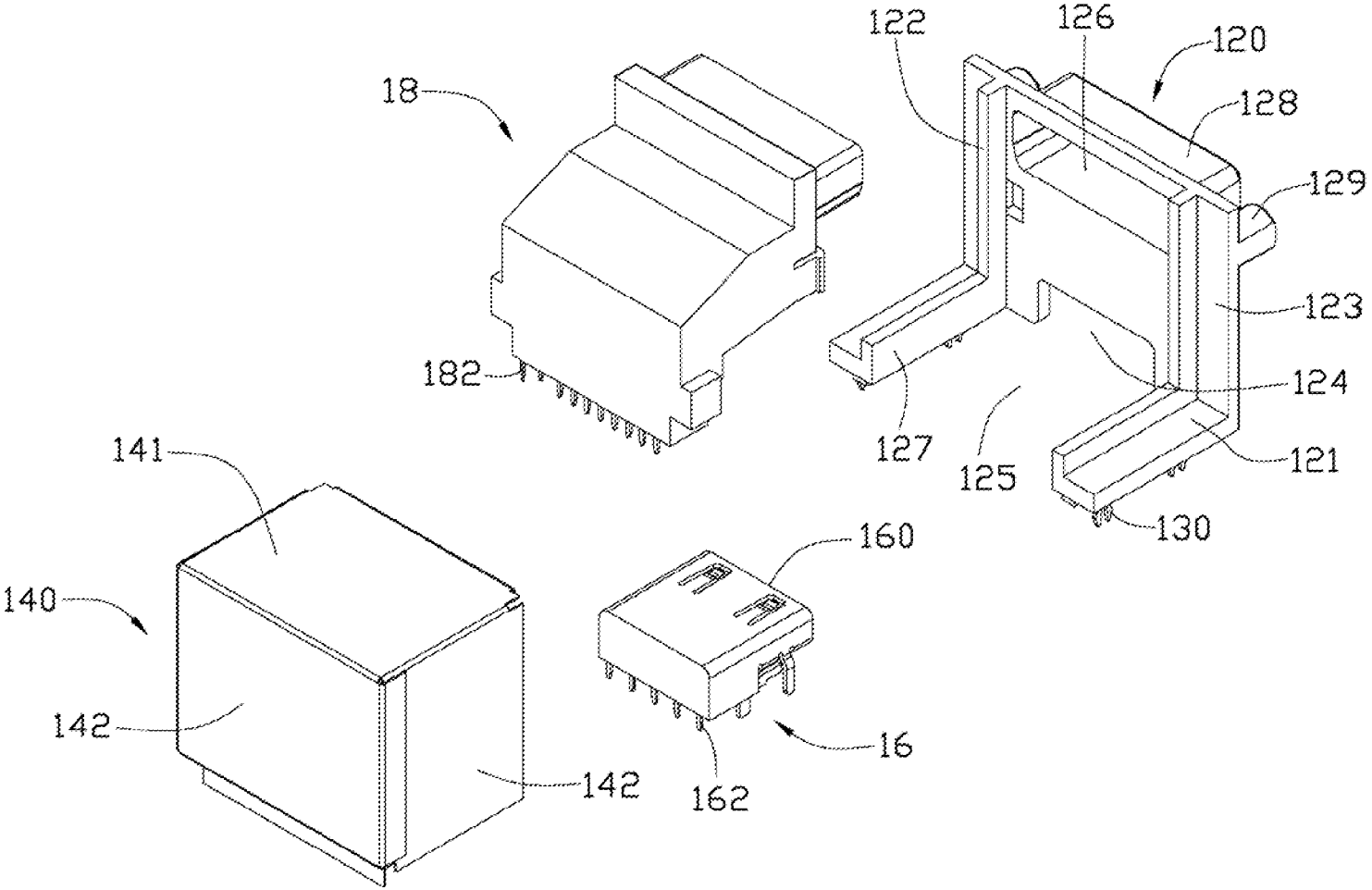
FIG. 3 is similar to FIG. 2, but shows the electrical connector viewed from another aspect.

The housing 12 includes a seat 120, and a cover 140 coupled to the seat 120. The seat 120 and the cover 140 cooperatively define a receiving space (not labeled) therebetween for receiving the HDMI 16 and the DVI 18 therein. Referring also to FIGS. 2 and 3, the seat 120 includes a sidewall 123 and two arms 121 extending from the sidewall 123 towards the cover 140.

The sidewall 123 is generally a rectangular plate. A cutout 124 is defined at a middle of a bottom edge of the sidewall 123. A window 126 is defined at an upper middle of the sidewall 123, adjacent to a top edge of the sidewall 123. The window 126 is substantially parallel to and spaced from the cutout 124. In this embodiment, the cutout 124 and the window 126 are substantially rectangular, and elongated. The window 126 is wider than the cutout 124. A flange 128 extends outwards from a periphery of the window 126 at an outer side of the sidewall 123, in a direction away from the cover 140. Two posts 129 extend perpendicularly out from the outer side of the sidewall 123, in the same direction away from the cover 140. The posts 129 are respectively located at opposite ends of the flange 128. A threaded hole 139 is defined in each of the posts 129.

The arms 121 extend substantially perpendicularly out from an inner side of the sidewall 123 which faces the cover 140. In this embodiment, the arms 121 respectively extend from opposite ends of the bottom edge of the sidewall 123. The arms 121 are elongated, and spaced apart from each other. A distance between the arms 121 is larger than the width of the cutout 124. That is, the arms 121 approximately surround the two ends of the cutout 124.

A first rib 127 extends up from an inner edge of each arm 121. The two first ribs 127 oppose each other. An opening 125 is defined between one of the arms 121 together with its first rib 127 and the other arm 121 together with its first rib 127. The opening 125 communicates with the cutout 124. Two second ribs 122 extend substantially perpendicularly out from the inner side of the sidewall 123. The second ribs 122 are substantially parallel to and spaced apart from each other, and each second rib 122 is elongated along a vertical direction. Each second rib 122 perpendicularly intersects one first rib 127.

A hook 130 extends down from each of opposite ends of each arm 121, for locking the connector 10 to a circuit board. A slit 133 is defined in each of the hooks 130 to separate a majority of the hook 130 into two portions. Thus the two portions of the hook 130 can elastically distort toward each other to allow the hook 130 to extend through a corresponding hole of the circuit board, and thereupon elastically resume their original positions to engage the circuit board at a periphery of the corresponding hole. In this way, the hooks 130 lock the connector 10 on the circuit board.

The cover 140 includes a rectangular top plate 141, and three side plates 142 respectively extending down from three sides of the top plate 141. When assembled, the seat 120 is coupled to the cover 140, with the inner side of the sidewall 123 facing a side of the cover 140 without the side plates 142. The top edge of the sidewall 123 is coplanar with the top plate 141 of the cover 140. The two first ribs 127 and the two second ribs 122 are located between two of the side plates 142 at opposite sides of the top plate 141, and respectively engage with these two side plates 142. Bottom edges of the two side plates 142 respectively abut against the two arms 121 of the seat 120.

The HDMI 16 includes a plurality of pins 162 extending down from a bottom thereof, and a HDMI port 160 formed at a lateral side thereof.

The DVI 18 includes a plurality of pins 182 extending down from a bottom thereof and a DVI port 180 formed at a lateral side thereof. A width of the DVI port 180 is larger than that of the HDMI port 160. In this embodiment, the width of the DVI port 180 is equal to that of the window 126 of the sidewall 123 of the seat 120, and the width of the HDMI port 160 is equal to that of the cutout 124 of the sidewall 123 of the seat 120.

Figure 4:
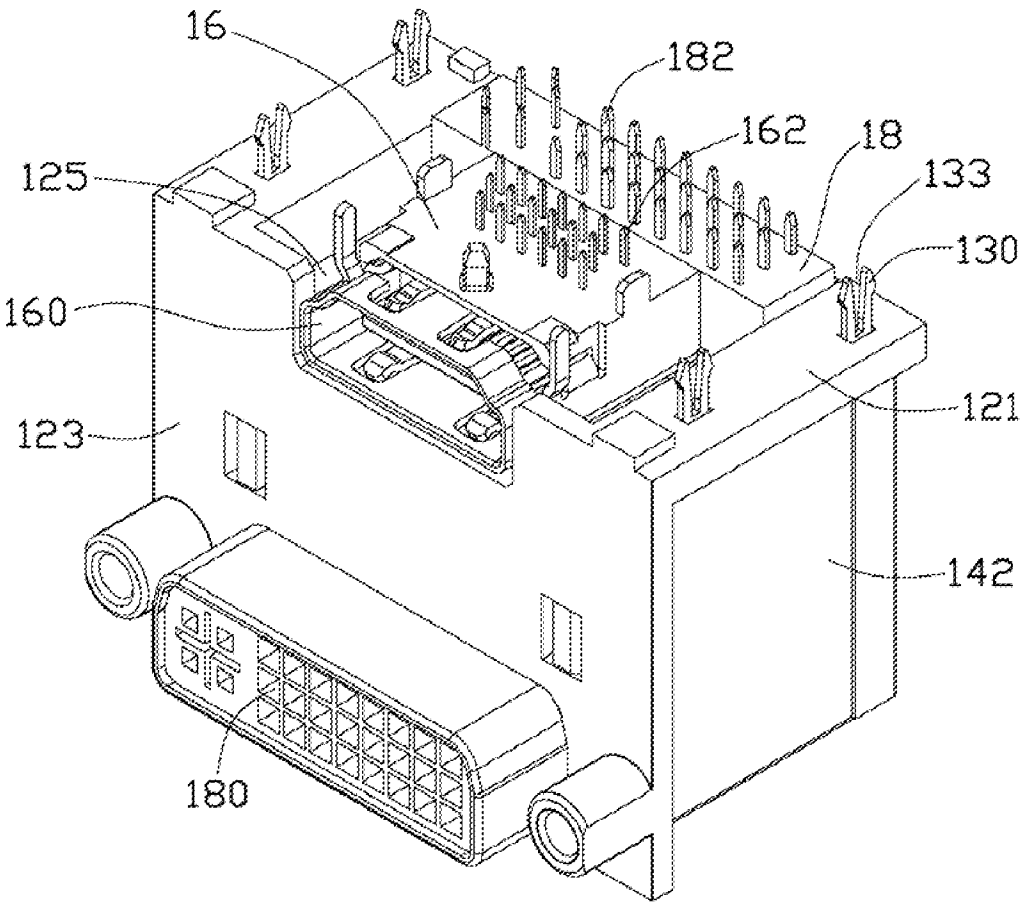
FIG. 4 shows the electrical connector of FIG. 1 inverted.

Referring also to FIG. 4, the HDMI 16 is disposed in the housing 12 with the HDMI port 160 extended into the cutout 124 of the sidewall 123. The pins 162 of the HDMI 16 protrude out of the housing 12 below the opening 125. The DVI 18 is disposed in the housing 12, with the DVI port 180 located above the HDMI port 160 and extended through the window 126 of the sidewall 123 and received in the flange 128. The pins 182 of the DVI 18 protrude out of the housing 12 below the opening 125. In this embodiment, bottom ends of the pins 182 of the DVI 18 and bottom ends of the pins 162 of the HDMI 16 are substantially coplanar. The bottom ends of the pins 182, 162 terminate in a common plane, which is at the same level as or higher than a common plane in which bottom ends of the hooks 130 terminate. When the connector 10 is fixed onto the circuit board by the hooks 130, the pins 182 of the DVI 18 and the pins 162 of the HDMI 16 are electrically connected to circuits of the circuit board.

Since the connector 10 has the DVI port 180 and the HDMI port 160, the connector 10 can be used for connecting different devices matching the DVI port 180 and the HDMI port 160. Further, the DVI 18 and the HDMI 16 are disposed in the housing 12 one above another. Therefore, an area occupied by the connector 10 should be less than that occupied by two individual connectors respectively having a DVI port and an HDMI port. Thus the connector 10 is suitable for the compact and light electronic devices.

It is to be understood, however, that even though numerous characteristics and advantages of certain embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An electrical connector, comprising:

a housing defining a space therein, the housing comprising a sidewall, the sidewall defining a cutout and a window above the cutout;

a high definition multimedia interface received in the space of the housing, the high definition multimedia interface comprising a high definition multimedia interface port received in the cutout and a plurality of pins protruding out from the housing;

a digital visual interface received in the space of the housing, the digital visual interface comprising a digital visual interface port received in the window and a plurality of pins protruding out from the housing; and a cover coupled to the sidewall to define the space therebetween, the cover comprising a top plate and three side plates depending from the top plate, the sidewall connected to a side of the cover without the side plates;

wherein a first rib extends up from each of the arms, and bottom edges of two of the side plates at opposite sides of the top plate are respectively disposed on the arms and engaged with the first ribs.

2. The electrical connector of claim 1, wherein the housing further comprises two arms extending out from a bottom edge of the sidewall, an opening is defined between the arms communicating with the cutout, and the pins of the high definition multimedia interface and digital visual interface protrude out from the housing below the opening.

3. The electrical connector of claim 2, wherein bottom ends of the pins of the high definition multimedia interface and digital visual interface are substantially coplanar.

4. The electrical connector of claim 2, wherein a plurality of hooks extends down from the arms for locking the connector to a circuit board.

5. The electrical connector of claim 1, wherein two second ribs extend out from the sidewall and respectively engage with the two of the side plates at opposite sides of the top plate, and the window and the cutout are located between the two second ribs.

6. The electrical connector of claim 1, wherein a flange extends out from a periphery of the window at an outer side of the sidewall away from the space.

7. The electrical connector of claim 1, wherein two posts extend out from an outer side of the sidewall away from the space, and the posts are located at opposite ends of the cutout.

8. The electrical connector of claim 1, wherein the window is wider than the cutout.

9. An electrical connector, comprising:

a housing comprising a seat and a cover coupled to the seat;

the seat comprising a sidewall and two arms extending from a bottom edge of the sidewall towards the cover, the sidewall defining a cutout and a window therein, a rib extending up from each of the arms, an opening being defined between the arms; and the cover comprising a top plate and three side plates depending from the top plate, bottom edges of two of the side plates at opposite sides of the top plate being respectively disposed on the arms and engaged with the ribs;

a high definition multimedia interface received in the housing, the high definition multimedia interface comprising a high definition multimedia interface port received in the cutout; and a digital visual interface received in the housing, the digital visual interface comprising a digital visual interface port received in the window.

10. The electrical connector of claim 9, wherein the digital visual interface port and the high definition multimedia interface port are arranged one above the other.

11. The electrical connector of claim 10, wherein the digital visual interface port is located above the high definition multimedia interface port.

12. The electrical connector of claim 9, wherein the digital visual interface and the high definition multimedia interface each comprise a plurality of pins protruding out from the housing below the opening.

13. The electrical connector of claim 12, wherein bottom ends of the pins of the digital visual interface and the high definition multimedia interface are substantially coplanar.

14. The electrical connector of claim 9, wherein a plurality of hooks extends down from the arms for locking the connector to a circuit board.

15. The electrical connector of claim 9, wherein two posts extend out from an outer side of the sidewall away from the cover, and the posts are located at opposite ends of the cutout.

16. An electrical connector, comprising:

a housing comprising a sidewall, the sidewall defining a cutout and a window above the cutout;

a cover coupled to the sidewall to define a space therebetween, the cover comprising a top plate and three side plates depending from the top plate, the sidewall connected to a side of the cover without the side plates;

a high definition multimedia interface received in the space, the high definition multimedia interface comprising a high definition multimedia interface port received in the cutout and a plurality of pins protruding out from the housing; and a digital visual interface received in the space, the digital visual interface comprising a digital visual interface port received in the window and a plurality of pins protruding out from the housing;

wherein two ribs extends out from the sidewall and respectively engage with two of the side plates at opposite sides of the top plate, and the window and the cutout are located between the two ribs.

* * * * *